US008100814B2

(12) United States Patent
Van Raalte et al.

(10) Patent No.: US 8,100,814 B2
(45) Date of Patent: Jan. 24, 2012

(54) CLAMBERING DEVICE

(75) Inventors: Koos Van Raalte, Bergschenhoek (NL); Ronald Andreas Jacobus Kazius, De Meern (NL)

(73) Assignee: Kompan A/S, Ringe (DK)

( * ) Notice: Subject to any disclaimer, the term of this patent is extended or adjusted under 35 U.S.C. 154(b) by 0 days.

(21) Appl. No.: 12/295,267

(22) PCT Filed: Mar. 29, 2007

(86) PCT No.: PCT/NL2007/000089
§ 371 (c)(1),
(2), (4) Date: Jan. 29, 2009

(87) PCT Pub. No.: WO2007/111502
PCT Pub. Date: Oct. 4, 2007

(65) Prior Publication Data

US 2009/0239712 A1 Sep. 24, 2009

(30) Foreign Application Priority Data

Mar. 29, 2006 (NL) ..... 1031458

(51) Int. Cl.
*A63B 9/00* (2006.01)

(52) U.S. Cl. ..... 482/35; 52/81.2; 403/172

(58) Field of Classification Search ..... 482/35, 482/37, 51; 403/170, 171; 52/245, 604, 52/605, 280
See application file for complete search history.

(56) References Cited

U.S. PATENT DOCUMENTS

| | | | | |
|---|---|---|---|---|
| 3,354,591 | A * | 11/1967 | Fuller | 52/81.2 |
| 3,632,109 | A * | 1/1972 | Dattner | 482/35 |
| 3,685,221 | A * | 8/1972 | Mangan | 52/80.1 |
| 3,785,096 | A * | 1/1974 | Neuhardt | 52/79.4 |
| 3,861,107 | A * | 1/1975 | Papayoti | 52/654.1 |
| 3,970,301 | A * | 7/1976 | Lehmann | 482/35 |
| 4,097,043 | A * | 6/1978 | Rudy | 482/35 |
| 4,506,688 | A * | 3/1985 | Bethoon et al. | 135/140 |
| 4,567,707 | A * | 2/1986 | Herman | 52/653.1 |
| 4,592,671 | A * | 6/1986 | Daum | 403/171 |
| 4,603,853 | A * | 8/1986 | Satterthwaite | 482/35 |
| 5,031,371 | A * | 7/1991 | Davister | 52/236.1 |
| 5,379,557 | A * | 1/1995 | Kotter | 52/81.1 |
| 5,732,518 | A * | 3/1998 | Roberts | 52/245 |
| 5,860,811 | A * | 1/1999 | Henderson | 434/255 |
| 6,059,631 | A * | 5/2000 | Maddock | 446/127 |
| 6,108,984 | A * | 8/2000 | Davidson | 52/81.1 |
| 6,551,216 | B2 * | 4/2003 | Rennex | 482/35 |
| 6,558,222 | B1 * | 5/2003 | Maddock | 446/105 |
| 6,658,800 | B2 * | 12/2003 | Monson et al. | 52/81.1 |
| 6,699,158 | B1 * | 3/2004 | Richardson et al. | 482/37 |
| 7,434,359 | B2 * | 10/2008 | Geiger | 52/81.3 |

(Continued)

FOREIGN PATENT DOCUMENTS

DE 3904722 A1 8/1990

(Continued)

*Primary Examiner* — Stephen Crow
(74) *Attorney, Agent, or Firm* — Muncy, Geissler, Olds & Lowe, PLLC

(57) ABSTRACT

Clambering device having a number of blocks defined by at least four geometrical surfaces, of which surfaces at least three have normals of which one is at an angle to the surface in which the other two are situated, wherein means for mutual coupling of the blocks are provided at those surfaces. The geometrical surfaces may be substantially flat, identical to each other in shape, or particularly congruent to each other.

12 Claims, 16 Drawing Sheets

U.S. PATENT DOCUMENTS

| | | | | |
|---|---|---|---|---|
| 7,572,207 | B2 * | 8/2009 | Postma | 482/37 |
| 7,627,993 | B1 * | 12/2009 | Letizi | 52/82 |
| 2007/0256370 | A1 * | 11/2007 | Whittingham | 52/81.1 |
| 2008/0276545 | A1 * | 11/2008 | Publicover et al. | 52/2.11 |

FOREIGN PATENT DOCUMENTS

| | | | |
|---|---|---|---|
| DE | 29505633 | U1 | 7/1995 |
| EP | 0329585 | A1 | 8/1989 |
| WO | WO-8101107 | | 4/1981 |
| WO | WO-03080193 | A1 | 10/2003 |

* cited by examiner

CLAMBERING DEVICE

BACKGROUND OF THE INVENTION

1. Field of the Invention

The invention relates to a clambering or climbing device and a component for it.

2. Brief Discussion of the Related Art

Clambering and climbing devices are known for use as training structure for climbing as a sport or as a play structure for children.

As climbing structure a wall is known, which has been provided with protrusions that have been arranged here and there and that may form supports for the climber moving along the wall. Such climbing walls are also used as play object for children.

Another modularly built-up clambering structure to be used by children is known from U.S. Pat. No. 5,941,041. The used module forms a curved plate provided with a number of protrusions and openings for hands or feet. The plates may be coupled to each other by means of lip/hole connections and edges that overlap each other. By means of the known modules a limited number of possible structures can be built.

From European patent application 0.384.439 a complex climbing wall is known, built up from a separate frame and wall elements attached thereto, that incline differently and have been provided with holes, protrusions and the like.

It is an object of the invention to provide a clambering device that is modularly built up and can be realised with the modules in many shapes and designs.

SUMMARY OF THE INVENTION

It is an object of the invention to provide a clambering device that is easy to set up.

It is an object of the invention to provide a clambering device that can be built up in several directions.

It is an object of the invention to provide a new and versatile element for clambering, particularly for children.

It is an object of the invention to provide an element for clambering that is easy to assemble.

From one aspect the invention provides a clambering device comprising at least two blocks having at least two sides each defining a geometrical surface, the geometrical surfaces of both sides having normals that are at an acute angle to each other, wherein the blocks at the location of one of the said sides are connected to each other.

In that way a wanted, robust structure can be modularly built up in an inclined direction. The blocks may comprise at least three sides each defining a geometrical surface, the geometrical surfaces of those sides having normals that are at a an angle to each other, in which way the number of possible construction designs is increased, particularly in a three-dimensional sense.

The construction possibilities are further increased when the edges of the said sides are spaced apart.

The normals of the geometrical surfaces of said sides may have directional components that are oriented away from each other.

In an advantageous embodiment each block forms a substantially spherical body, provided with corners. The surface of each block may have been formed by a number of polygons.

From a further aspect the invention provides a clambering device comprising a number of blocks defined by at least four geometrical surfaces, of which surfaces at least three surfaces have normals of which the one is at an angle to the surface in which the other two are situated, wherein at least two blocks are connected to each other at those surfaces.

In that way a clambering structure can be modularly built up and extended in various directions into a three-dimensional structure.

The geometrical (flat) surfaces indicate the location of the edges of those sides. The surface of the sides may for instance be concave or convex or a combination thereof, fluent or with discontinuities.

In one embodiment the sides are substantially flat, thus enhancing a stable mutual coupling. The number of possible shapes can be increased when the geometrical surfaces are identical to each other in shape, particularly congruent to each other. The same applies when the geometrical surfaces are regular.

The geometrical surfaces may form polygons. In one embodiment thereof the polygons are pentagons. In a simple embodiment the surfaces have been provided with connection means at the corners for connection to another block.

For making the design of the structure to be built up easier, at least two surfaces may be parallel to each other. This is further enhanced when there are several pairs of mutually parallel surfaces.

In one embodiment of the device according to the invention it comprises a series of blocks coupled to each other, wherein one of the blocks is standing on or has been attached to a floor and/or another block is leaning against or has been attached to an upright wall.

In one embodiment the normals of adjacent surfaces include an external angle comprising at least 90°, preferably exceeding 90°. The said angle may have been formed between all adjacent surfaces, resulting in a kind of angular sphere.

From a further aspect the invention provides a clambering device comprising a number of blocks defined by at least four surfaces, of which surfaces at least three surfaces have normals of which each pair of normals is situated in a surface that is at an angle to the surfaces in which the other pairs of normals are situated, wherein means for interconnection of the blocks may have been provided at those surfaces.

From a further aspect the invention provides a clambering device comprising a number of identically shaped blocks, which are substantially spherical having an outer surface defined by a series of flat surfaces and are connected to each other by connection means arranged at the location of the surfaces, corners or ribs.

The spherical block may have a radius of several decimetres, as a result of which a rather large structure can be built up using few block-shaped modules.

In one embodiment the blocks may be directly connected to each other, such as at two adjacent surfaces of two blocks, preferably rigidly.

In another embodiment the blocks may be indirectly connected to each other, preferably rigidly. An example thereof is an assembly of two blocks which by means of a bar have been connected to each other. An example of a connection that is not rigid, is a connection by means of a rope, a net or a rope bridge.

From a further aspect the invention provides a polygonal, substantially spherical block, in its surfaces provided with means, such as holes, for attaching climbing holds onto the surfaces.

From a further aspect the invention provides a polygonal, substantially spherical block, provided with climbing holds on the surfaces.

From a further aspect the invention provides a polygonal, substantially spherical block, provided with means for connection to another identically shaped block, preferably on all surfaces.

From a further aspect the invention provides a block suitable and intended for a clambering device according to the invention. The block itself may have been assembled from modular parts.

The block may have been built up from a construction kit of plates forming the sides and connection pieces. In one embodiment the connection pieces are situated at the corners only resulting in a simple construction.

In an advantageous further development thereof the connection pieces are also adapted for connecting the block to another block.

The invention furthermore relates to an assembly of such a block and means for connection to a similarly shaped block. The aspects and measures described and/or shown in the application may where possible also be used individually. Said individual aspects and other aspects may be the subject of divisional patent applications relating thereto. This particularly applies to the aspects as mentioned per se in the claims.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will before more fully understood from the foregoing detailed description and the attached drawings, which are given by way of illustration only, and thus are not limitative of the present invention, and in which.

DETAILED DESCRIPTION OF THE PREFERRED EMBODIMENTS

Figure 1A:
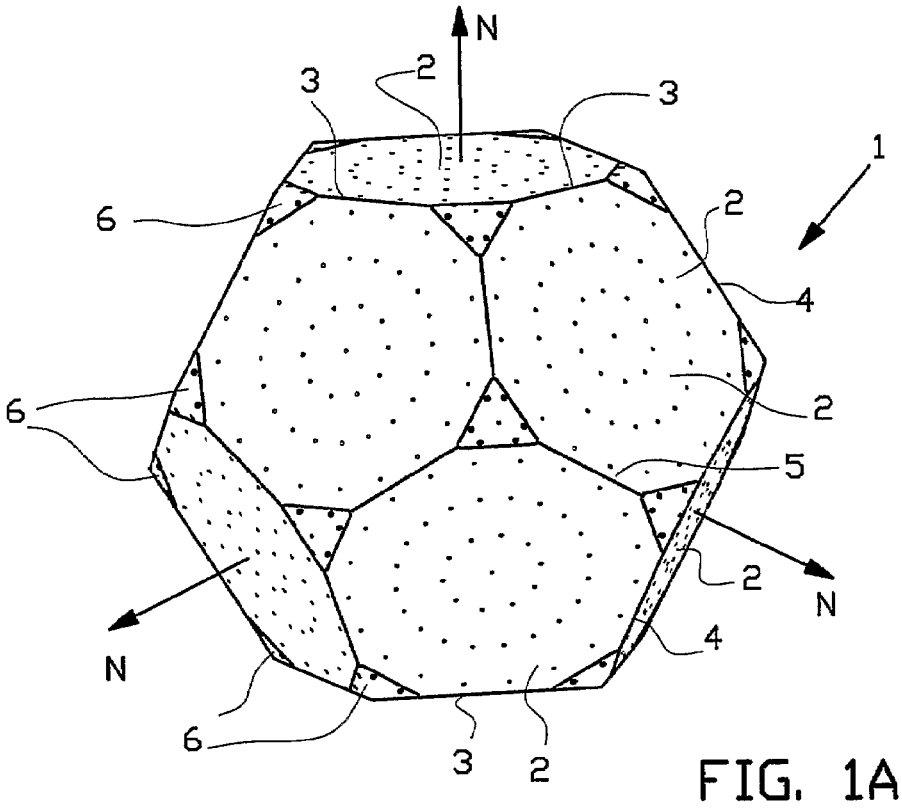
FIG. 1A shows an exemplary embodiment of a block for a clambering device according to the invention.

The block 1 of FIG. 1 has been built up from a construction kit of plates 2 and corner pieces 6. The plates 2 form a series of regular, identical, pentagonal plates 2, in this example twelve, wherein each time two plates 2 situated on opposite sides of the block 1 are situated parallel to each other. The block 1 thus forms a dodecahedron. In the example an upper plate and a lower plate and ten side plates have thus been formed, which are arranged so as to stagger. In that way the upper plate 2 and the lower plate 2 are bounded by ribs 3, and the five uppermost side plates are bounded on top by ribs 4 that extend downwardly inclined and the five lowermost circumferential plates are bounded by circumferential ribs 4 that extend upwardly inclined. Between the uppermost side plates 2 and the lowermost side plates 2 ribs 5 have been formed, which run in a zig-zag manner, as can be seen in FIG. 1. The length of the ribs 3, 4, 5 in this example is several decimetres, for instance 6 decimetres.

Figure 1B:
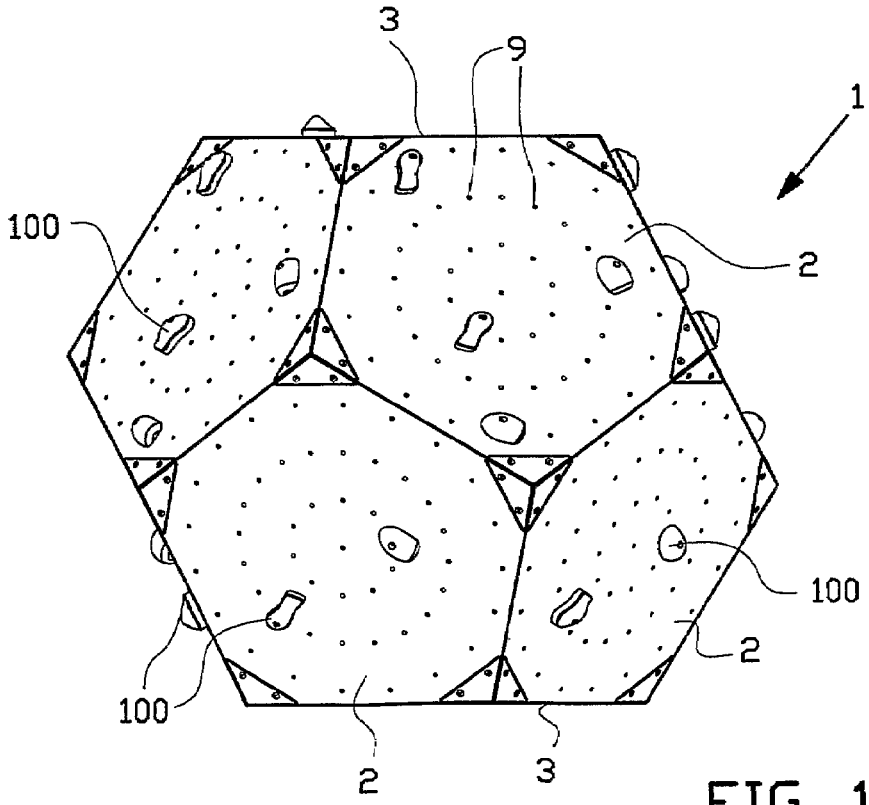
FIG. 1B shows the block of FIG. 1 with climbing holds.
Figure 2A:
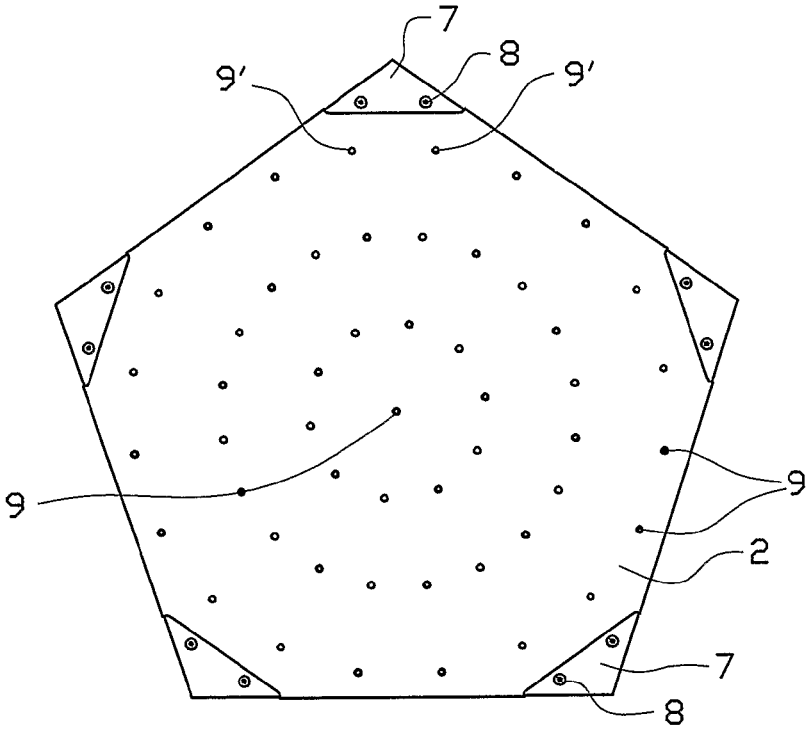
FIGS. 2A, 2B and 2C show modular parts for assembling the block according to FIG. 1.

The block 1 of FIG. 1 has been assembled from the parts shown in the FIGS. 2A/B and 2C, pentagonal plates 2 and concave tetrahedral corner pieces 6, respectively. At their outside the pentagonal plates 2 have been provided with thinned corner areas 7, in which holes 8 have been provided. The plates 2, as regards outermost corner areas 7, have been provided with holes 9, in which climbing holds or other aids can be attached, optionally. The holes 9 have been arranged in several concentric circles. They have been symmetrically arranged, regularly distributed with respect to the corners. The plates 2 may in that case have been provided with marks (for instance on a scale of 1-5 in levels of difficulty) to place the climbing holds, related to a certain route to be traversed over the block or over a series of blocks. In FIG. 1B the block 1 is shown with climbing holds 100 which have been attached in holes 9 by means of bolts.

Figure 2B:
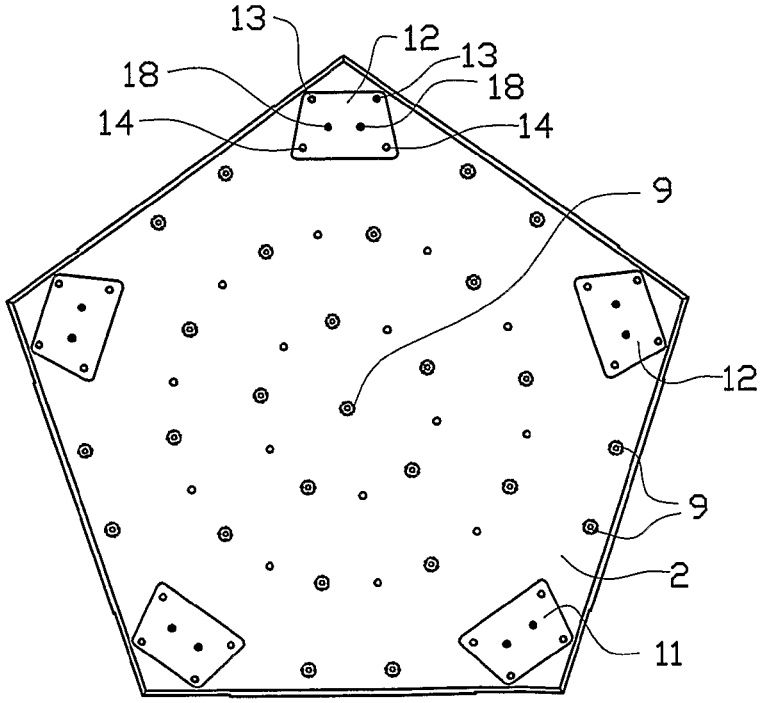
Figure 2C:
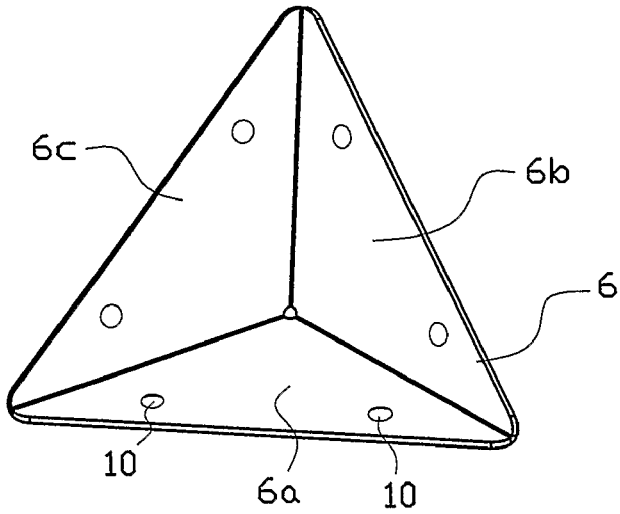

As can be seen in FIG. 2B, at the inside, the plates 2, have been provided with connection plates 12, which in turn have been provided with holes 13, 14 and 18. The holes 18 are for screws 18, with which the plate 12 can be attached to the plate 2. The holes 13 are in that case in line with holes 8 and holes 14 are in that case in line with holes 9'. On the plate 12, nuts 15, 16 may have been attached in front of the holes 13 and 14. In FIG. 2B it is also shown that a number of the holes 9 may have been provided with nuts attached at the inside of the plate 2.

The corner piece 6 shown in FIG. 2B has three surfaces 6*a*, 6*b*, 6*c* that have been provided with holes 10 for flush accommodation of a screw head.

Figure 2D:
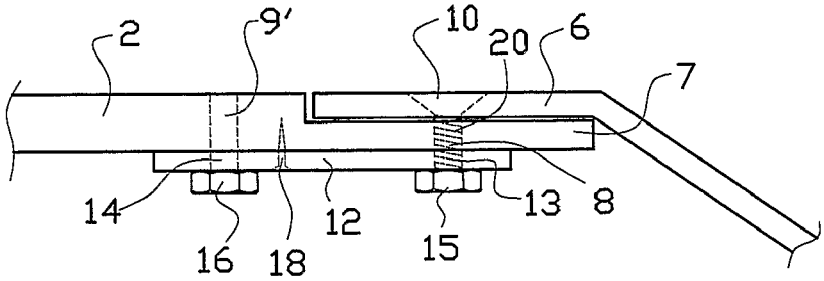
FIG. 2D shows a detail on a connection of the parts of FIGS. 2A-C.

When assembling the block 1 the regular/pentagonal plates 2, that are congruent to each other, are attached to each other by first attaching corner pieces 6 onto a number of plates 2, wherein (see FIG. 2D) two screws 20 are inserted through holes 10, 13 and into nuts 15. This can be done from the outside, so that in that way a full dodecahedron can be made, that is stable as regards shape and able to take large forces, and has the shape of a sphere having flat sides.

Figure 2E:
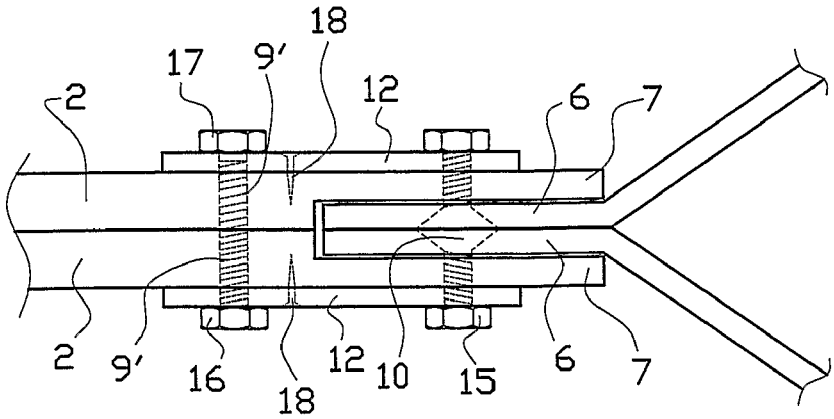
FIG. 2E shows a detail of a possible connection between two blocks.

If coupling to another, for instance identical block 1 is desired, one of the plates 2 can be left out as yet in said block so that access is provided to the inside of the block. As shown in FIG. 2E, after bringing the holes 9' of plates 2 to be placed against each other in line, screws 17 can be inserted from the inside and tightened in the nuts 16. When this has taken place at five corners of the plate 2, the last plate 2 is arranged and a stable assembly of two blocks 1 has been realised. In a comparable manner extension can take place with consecutive blocks 1. In this example the plates 2 of both blocks that are connected to each other abut each other, as a result of which the stability and strength may become large.

The blocks 1 can be detached from each other again. They in turn can also be disassembled again.

Alternatively such blocks 1 may for instance be attached to each other by aligning them by means of a connection pin inserted through a centre hole 9 in an upper surface 2. After two blocks 1 have been placed on top of each other and have been rotated in the correct desired position with respect to each other, wherein two corner pieces of both blocks 1 touch each other, a weld can be made there. Other ways of attaching are possible, for instance by means of gluing, depending on the type of material used. The material of the plates 2 and the corner pieces 6 can be chosen as desired.

Figure 3A:
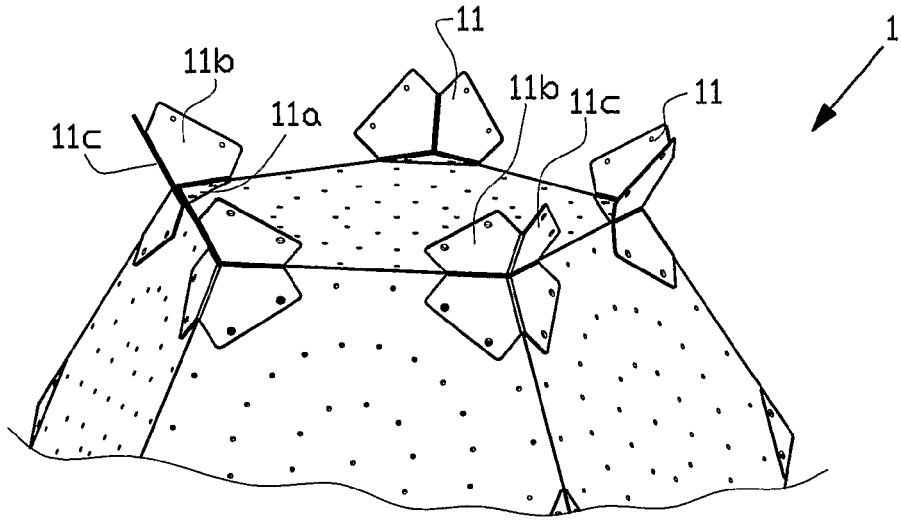
FIGS. 3A and 3B show a detail of a side of a block of FIG. 1 provided with alternative connection means and an assembly of two blocks of FIG. 1, connected to each other, respectively.
Figure 3B:
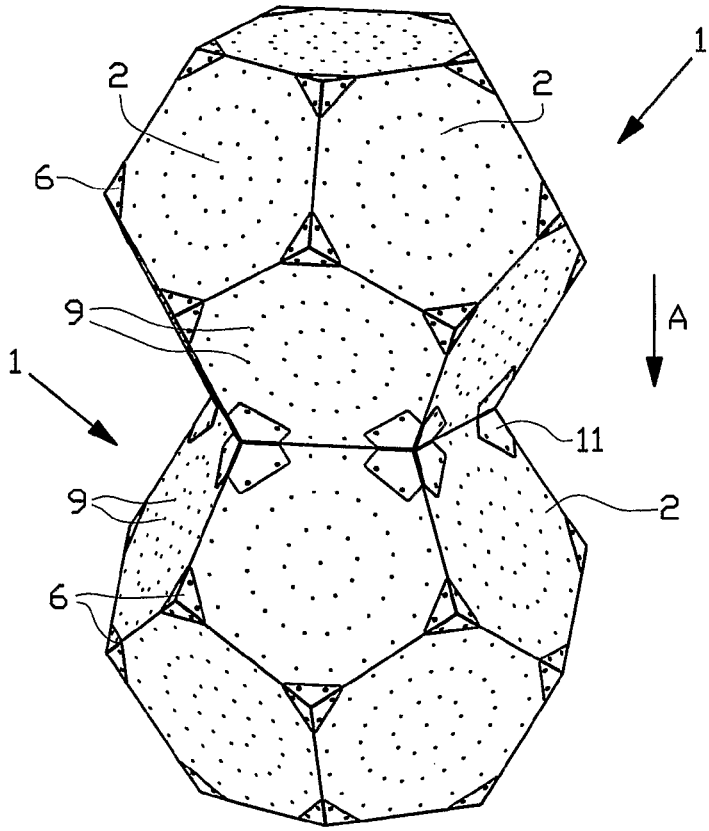

Another way of attaching is shown in FIGS. 3A and 3B. In that case the holes 9 adjacent to the thinned corner area 7 are used for attaching connection pieces 11, that have been provided with plates 11 *a*, 11 *b* and 11 *c*. After at the desired coupling side 2 at each vertex via its plate 11 *a* such a connection piece 11 has thus been attached, from the direction A, see FIG. 3B, a second block 1 can be placed, wherein the corner pieces 6 at the lower surface 2 thereof fit within the connection pieces 11. The upper block 1 is then attached by means of screws passed through the connection plates 11 *b*, 11 *c*, which then also extend through the holes 9 offered for that purpose in the lowermost side surfaces 2 of the uppermost block 1.

A possible slit between both blocks 1 can be finished, for instance by means of silicone paste.

Figure 4A:
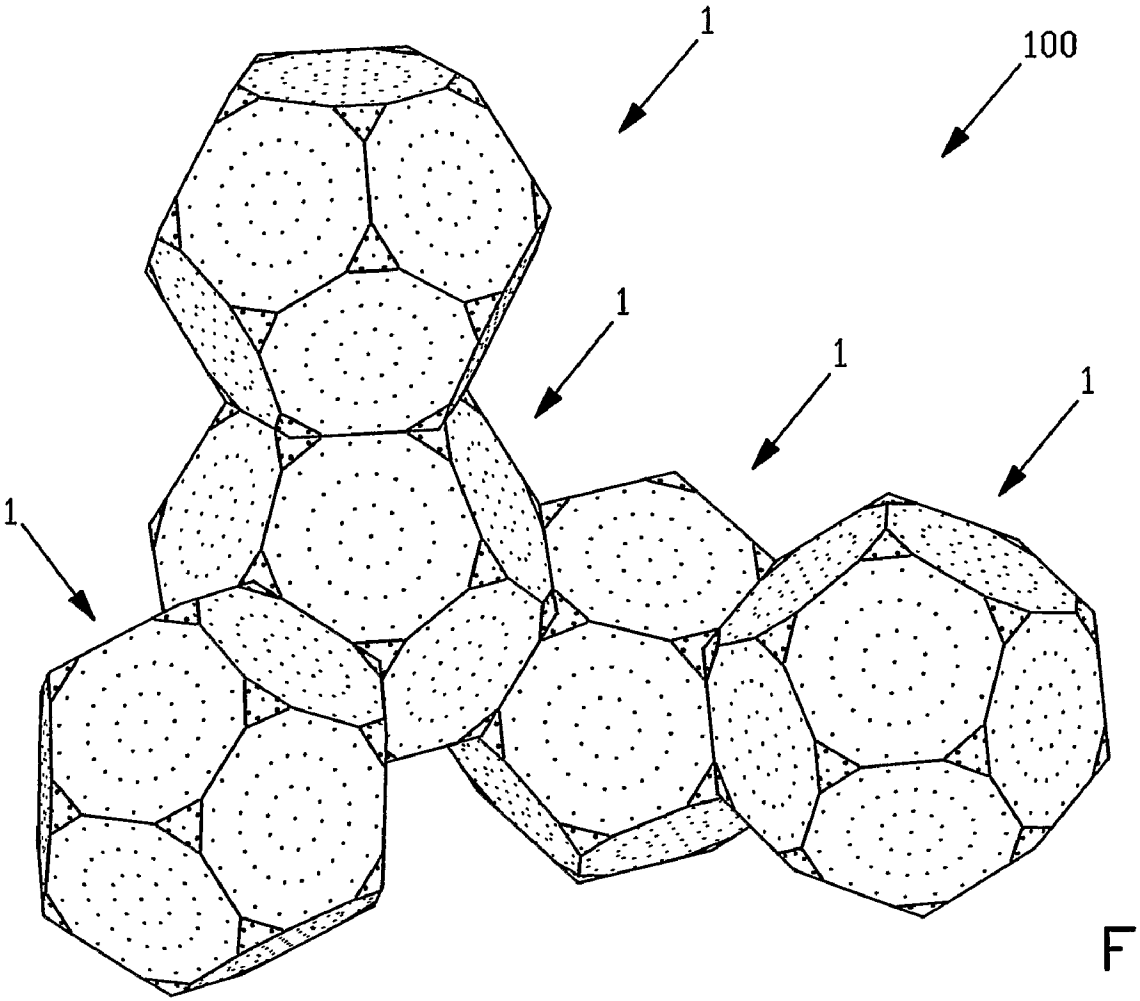
FIGS. 4A-D show a number of possible embodiments of a clambering device according to the invention with blocks, a block, respectively, of FIG. 1.
Figure 4B:
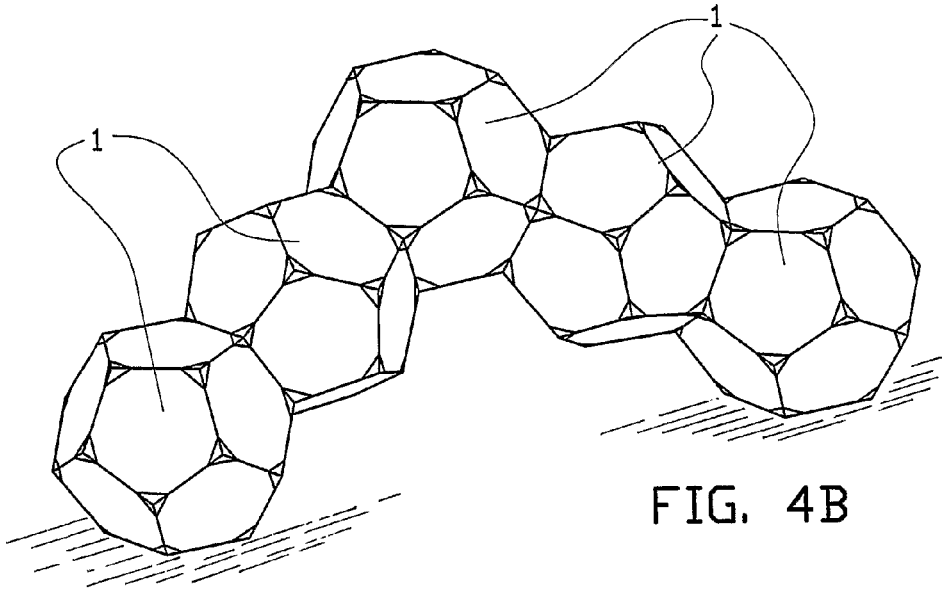
Figure 4C:
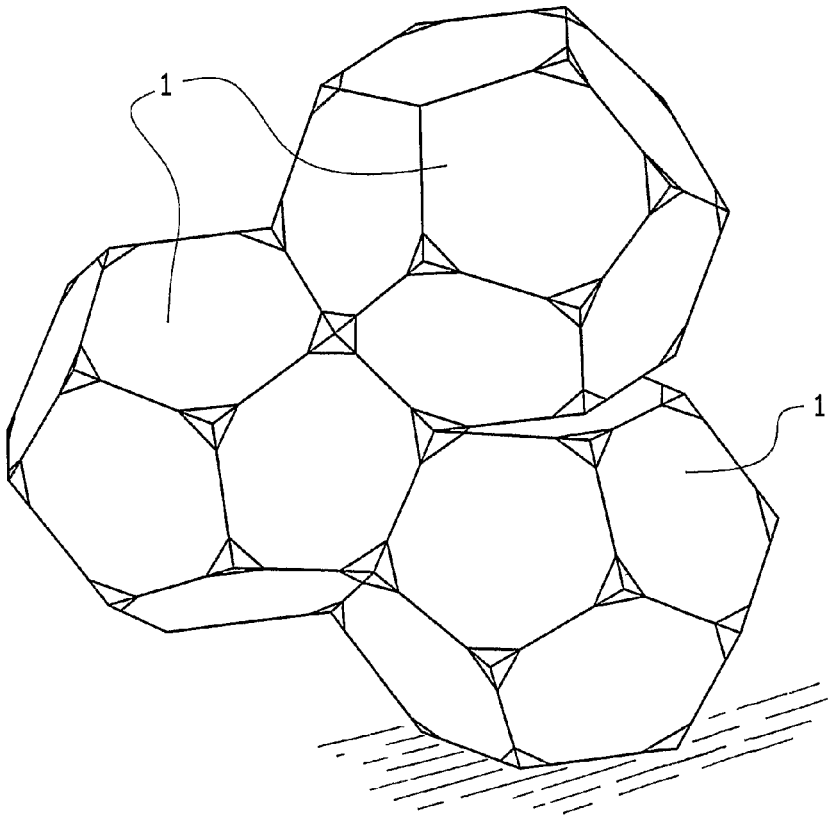
Figure 4D:
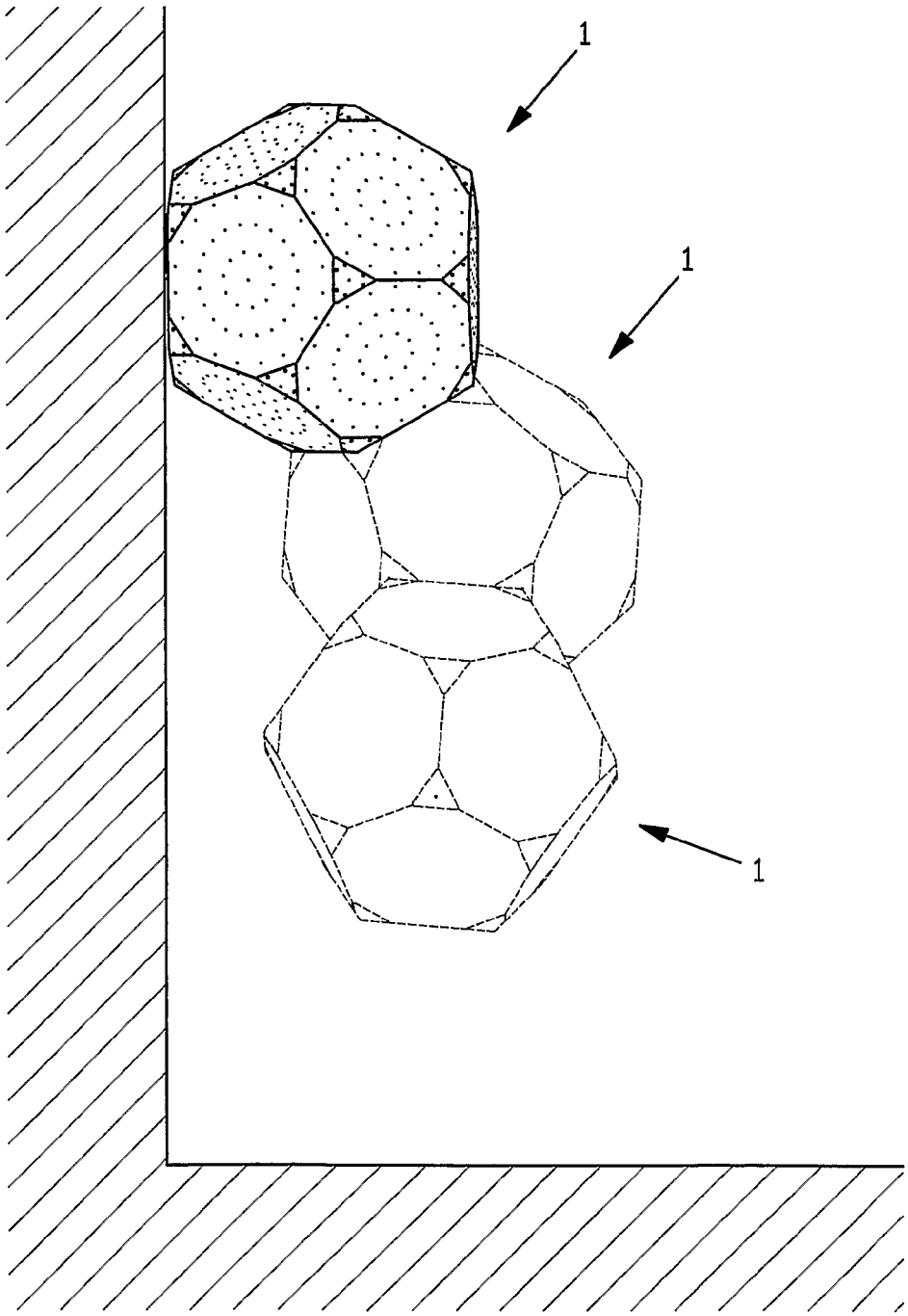

The connection pieces 11 may be/have been arranged on any suitable surface 2. As can be seen in FIG. 1 the normals of each set of three plates 2 are not situated in one surface with each other. In that way it is possible to extend a block structure in many directions. Examples thereof are shown in the FIGS. 4A-C. Such structures may be appealing to youngsters to clamber on. In FIG. 4D an arrangement is shown in which one block, for instance having a radius of the circumscribed circle of 6 dm, has been attached to a wall, spaced apart from the ground. Optionally, as shown in dashed lines, a next block may be suspended from said block. Many other arrangements are possible, using one or several blocks attached directly or indirectly to each other. For instance one block may be attached on a pole.

The holes 9 may furthermore be used for attaching accessories to the side plates 2, to further vary the support pattern for a climbing action.

Figure 5A:
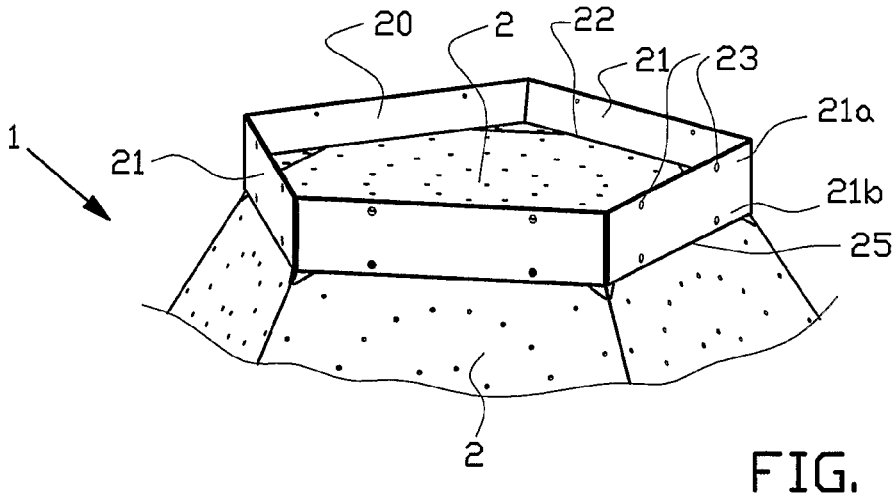
FIGS. 5A and 5B show a further alternative embodiment of connection/coupling means for two blocks of a clambering device according to the invention.
Figure 5B:
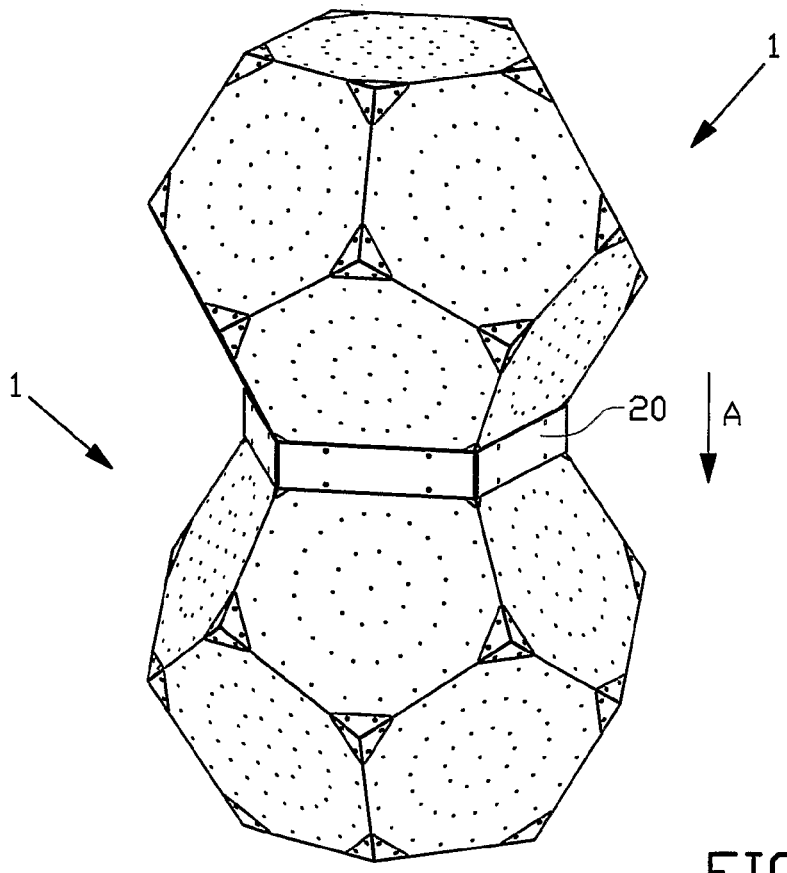

In FIGS. 5A and 5B an alternative way of connecting two blocks 1 is shown. The lowermost block 1 is in this case provided with a pentagonal collar 20 having a triangular cross-section, built up from upright, outer strips 21 and inclined inner strips 21 *a*, 21 *b* having a transitional edge 22 in between them. The collar 20 fits onto the uppermost plate 2, wherein the inner strips 21 *a* surround the upper edge of the block 1, abutting the uppermost edge areas of the side surfaces 2. At the location of holes 23, the strips 21 and 21 *a* are then attached by means of screws to holes 9 situated behind it, which holes are in the side surfaces 2 of the lowermost block. A block 1 to be positioned on top of it is lowered in the direction A until the lowermost surface 2 is on the uppermost surface 2 of the lowermost block 1. Subsequently both blocks 1 are secured onto each other by means of screws inserted through the holes 23 of the strips 21, 21 *b* and holes 9 in the lowermost side surfaces 2 of the uppermost block 1. The collar 20 may optionally be made higher, in which case both plates 2 remain spaced apart.

Figure 6A:
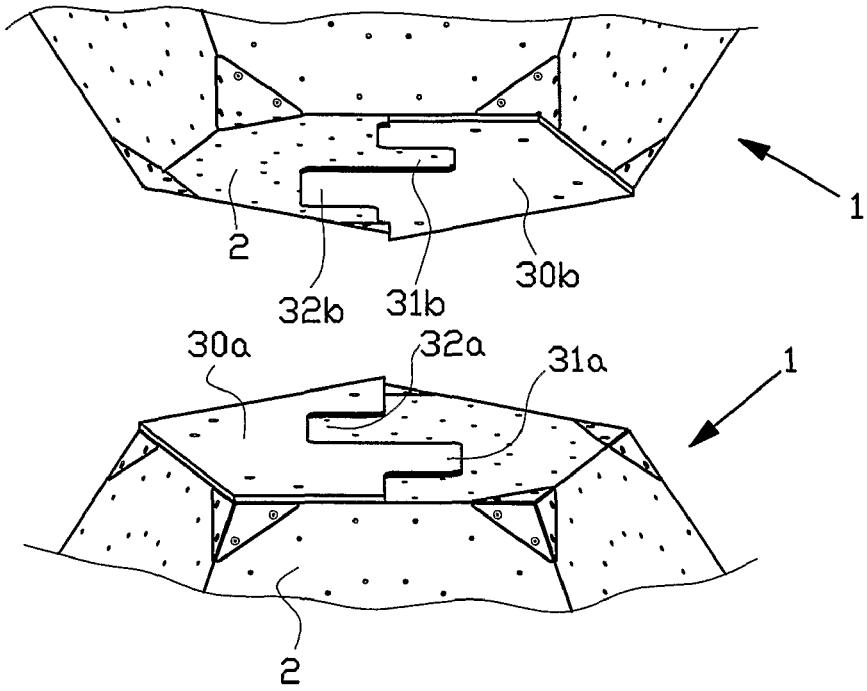
FIGS. 6A and 6B show a further alternative embodiment of connection/coupling means for two blocks of a clambering device according to the invention.
Figure 6B:
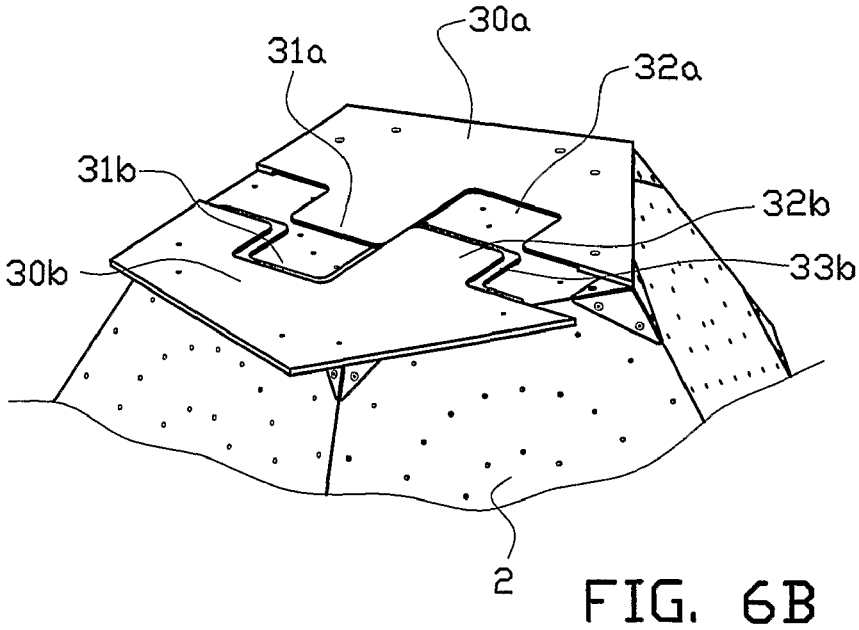

An alternative way of attachment is shown in the FIGS. 6A, 6B. In this case on two surfaces 2 of blocks 1 to be coupled to each other, for instance wooden plates 30*a,b* are attached, which have been provided with recesses 31 *b*, 32*a* and with protrusions 31 *a*, 32*b*. They have been provided with overhanging, and underhanging edges 33*a, b*, respectively, so that, as shown in FIG. 6B, they can be inserted into each other, in order to thus effect a coupling between both blocks 1.

Figure 7A:
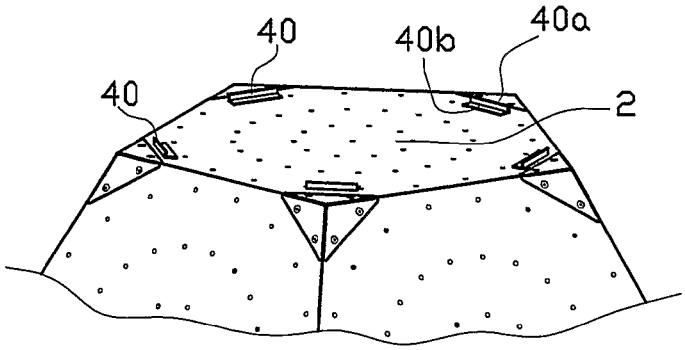
FIGS. 7A-C show a view of a block of FIG. 1 with further alternative connection means, and two consecutive stages in the connection of two blocks in a clambering device according to the invention.
Figure 7B:
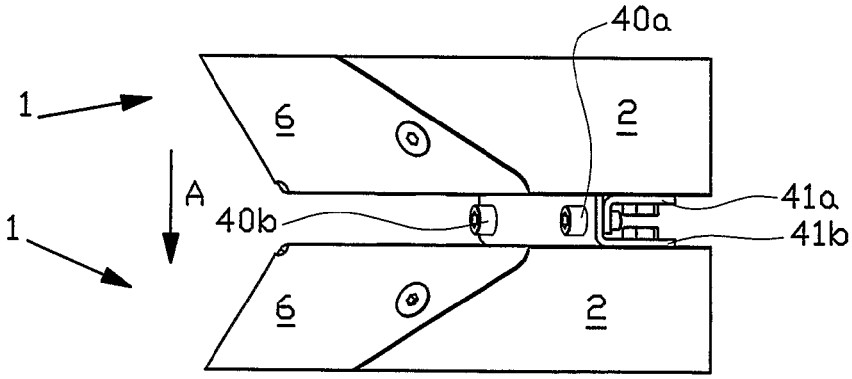
Figure 7C:
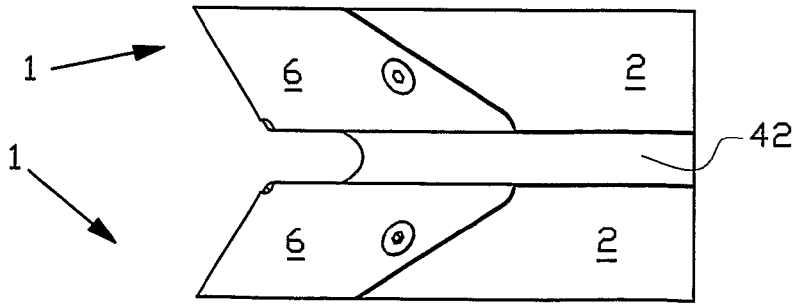

A further alternative is shown in FIGS. 7A-C, wherein on the upper surface 2 of a block 1 corner brackets 40 have been provided. For that purpose screws have been passed through the holes 9, in order to attach the lowermost leg 40*b* thereof to the surface 2. At the lower surface 2, a block 1 to be placed on top has been provided in a comparable manner with corner brackets 41 that have slightly shorter legs 41 *a*, so that as shown in FIG. 7B its upright legs 41 *a* fall just within the upright legs 40*b* of the corner brackets 40. By means of bolts both corner brackets are attached to each other. The slit space then remaining can be filled with a rubber profile 42, see FIG. 7C.

Figure 8A:
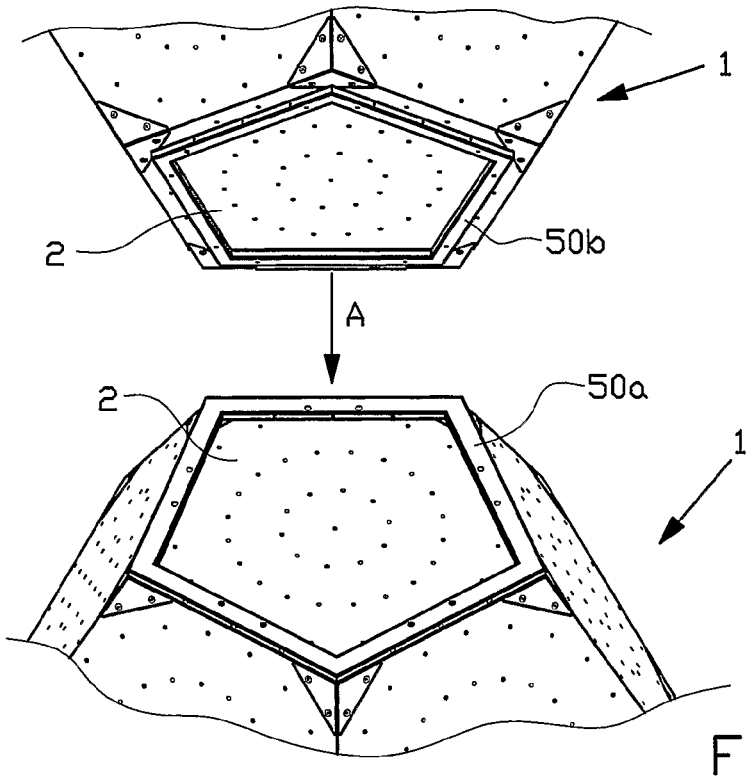
FIGS. 8A and 8B show two blocks for a clambering device according to the invention to be connected to each other, in a stage prior to interconnection and after interconnection, respectively.
Figure 8B:
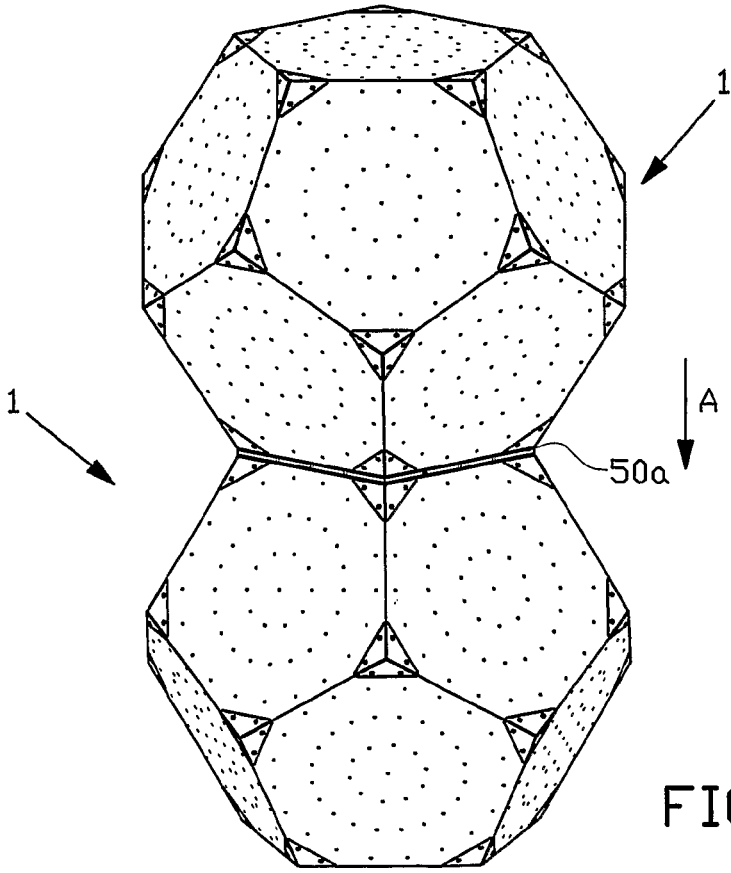
Figure 9A:
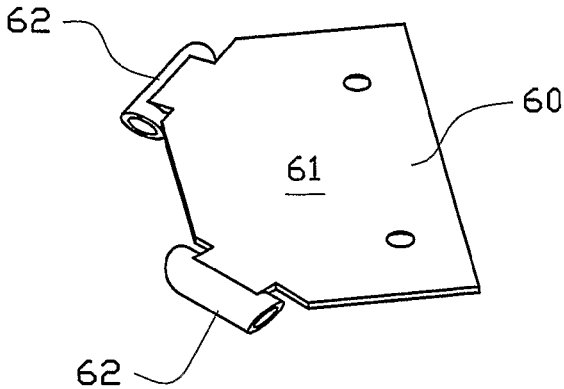
FIGS. 9A-G show a number of connection parts for connecting two blocks for a clambering device according to the invention in an alternative embodiment, consecutive stages of joining together, and in the connected situation, respectively.
Figure 9B:
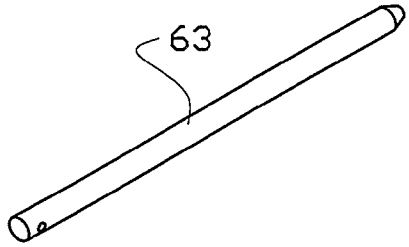
Figure 9C:
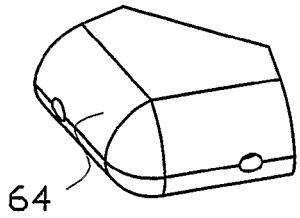
Figure 9D:
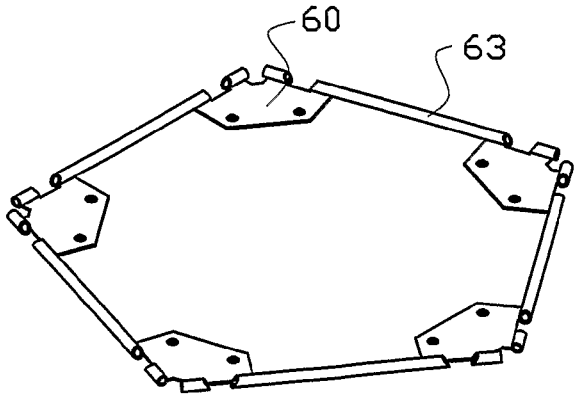
Figure 9E:
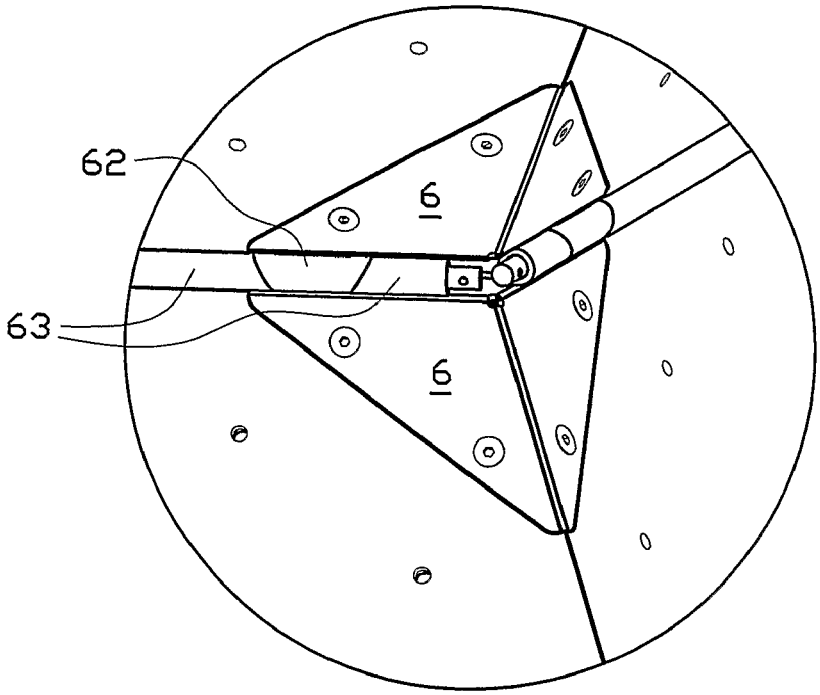
Figure 9F:
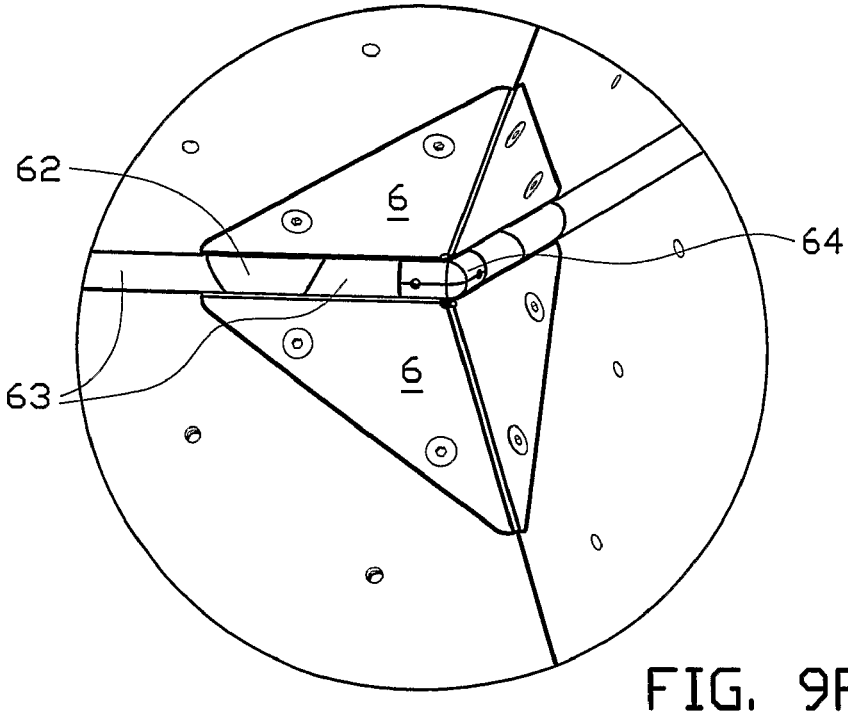
Figure 9G:
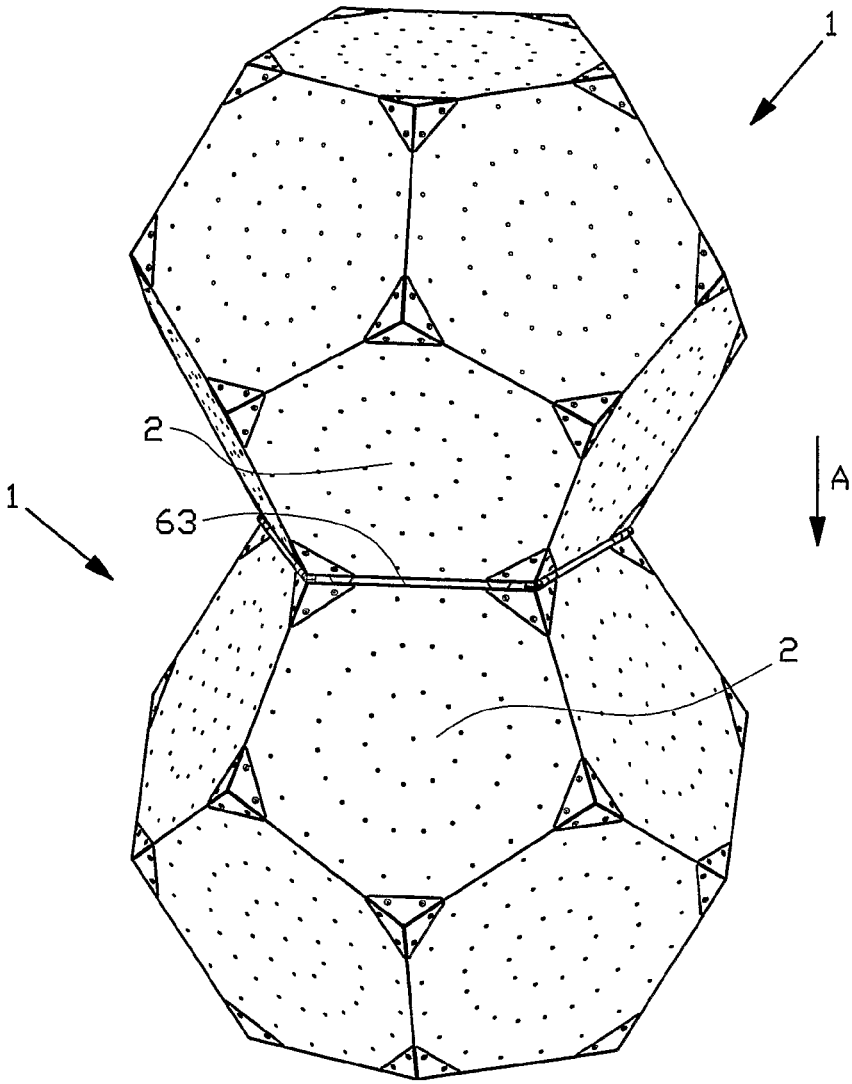

A further alternative is shown in FIGS. 8A, B, wherein on a lowermost block 1, at its upper surface 2, a pentagonal edge profile 50*a* is attached, again using screws for attachment to holes 9 along the circumferential edge of the upper surface 2. The bottom surface 2 of the block 1 to be placed on top has been provided with a pentagonal edge profile 50*b*, of which the outer circumference corresponds with the inner circumference of the lowermost edge profile 50*a*. In a comparable manner, the edge profile 50*b* is attached to the bottom surface 2. When both blocks are joined together, both edge profiles 50*a*, 50*b* fit snugly into each other, see FIG. 8B, and they are fixed to each other by additional means (not shown) in order to secure both blocks together against a motion that drives them apart.

In a further alternative embodiment, see FIGS. 9A-G, two blocks 1 may also be attached to each other in the way of hinge leaves, wherein a hinge leaf 60 intended to be attached to the corners of a lower plate 2 of an uppermost block 1 shown in FIG. 8A, comprises a plate 61, which by means of screws can be attached in holes 9, and two bushes 62. As can be seen in FIG. 8E a comparable hinge plate can be attached to the upper plate 2 of a lowermost block 1, with bushes 63 connecting to bushes 62 on either side thereof. The edges of the bushes 62 have been beveled such that they can easily be inserted between the bushes 63. The connection furthermore comprises screws 63, that can be passed through the bushes 62, 63. As can be seen in FIG. 8E, this may take place from the open corners, after which the corners can be covered by the corner cap 64 shown in FIG. 9C. The connection between the blocks is then without the sharp tips.

Figure 10A:
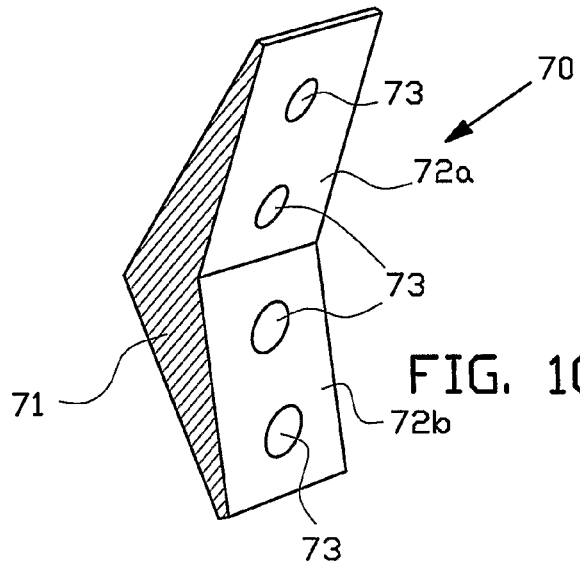
FIGS. 10A and 10B show an alternative coupling of blocks according to the invention and application thereof.

FIG. 10A shows a connection piece 70, comprising a V-shaped body with, in this example, identical legs 72*a,b* in which bolt holes or screw holes 73 have been arranged. When connecting two blocks 1 the outer sides of the V-shaped body are placed against surfaces 2 of both blocks 1, wherein the holes 73 are in line with its holes 9. The angle between both outer sides of the V-shaped body 71 corresponds with twice the outer angle between adjacent side surfaces 2, as can be seen in FIG. 10B. Alternatively the connection piece may comprise two flat wings. The body 71 shown, however, may be more advantageous taking the rigidity of the connection into consideration.

Figure 10C:
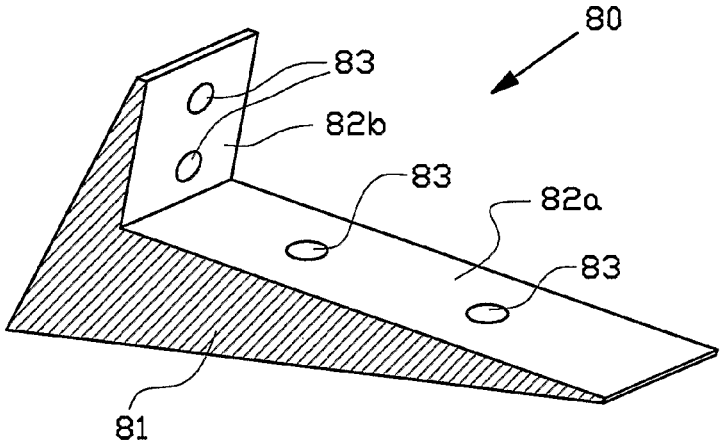
FIGS. 10C and 10D show a support for a block according to the invention and application thereof.
Figure 10D:
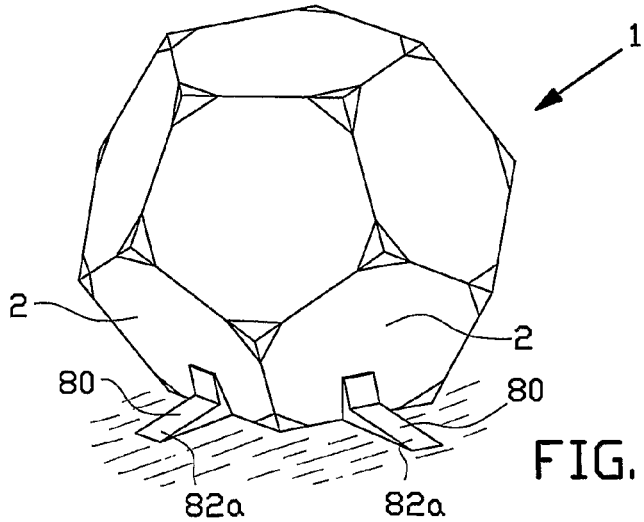
Figure 10B:
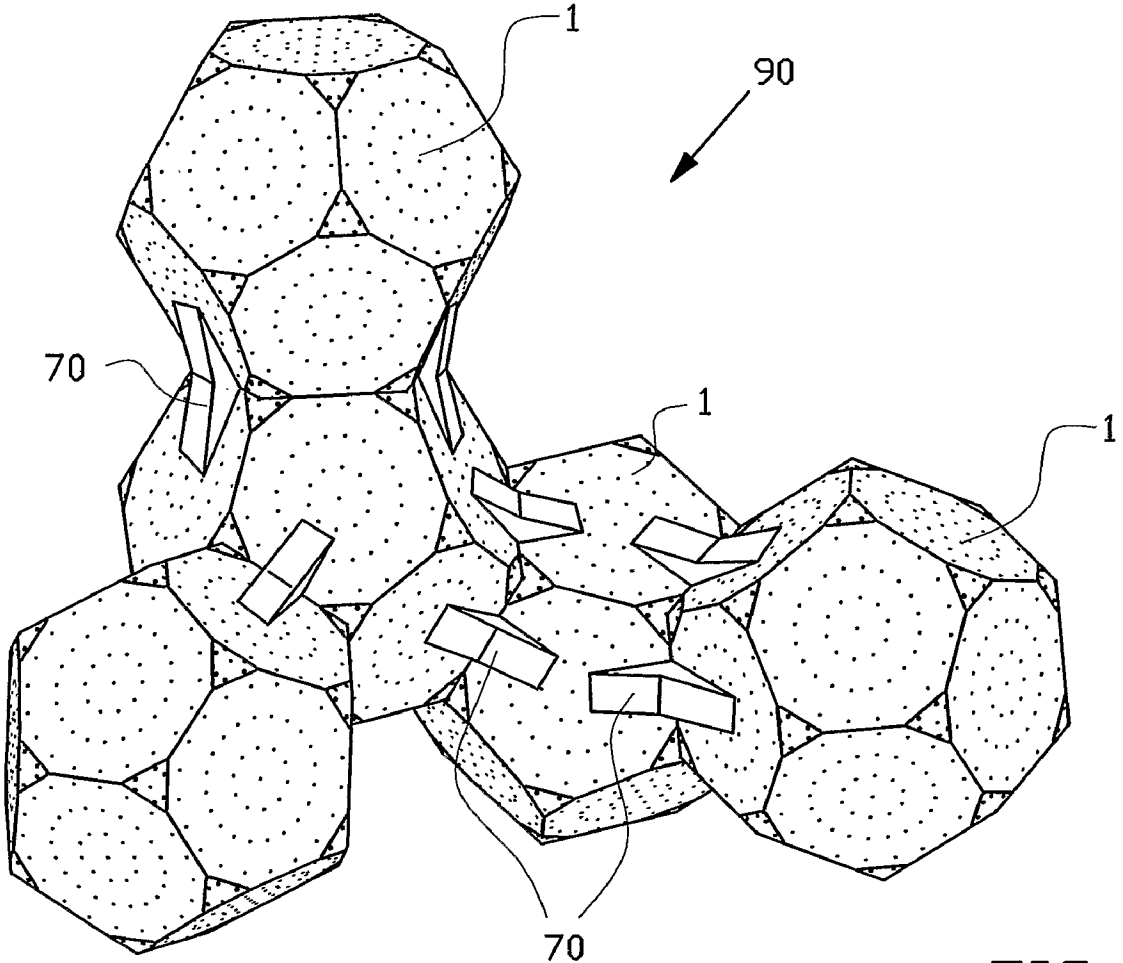

FIG. 10C shows a connection piece 80, having a V-shaped body 81 having a long leg 82*a* and a short leg 82*b* (comparable with the length of a leg 72*a,b*). The short leg 82*b* has been provided with holes 83. The long leg 82*a* may also have been provided with such holes. As can be seen in FIG. 100 the legs 82*b* of connection pieces—or support pieces—80 can be attached to side surfaces 2 of a block 1, using screws or bolts that extend through holes 9 in those surfaces 2. The legs 82*a* support on a basis and stabilise the block 1. Optionally one or several legs 82*a* can be secured on the basis.

The connection pieces 70, 80 can be arranged externally and may have been manufactured of any suitable material, and optionally be provided with climbing holds.

It is noted that the blocks can also be assembled in a different manner, for instance by joining partial blocks, for instance pyramid-shaped partial blocks having a pentagonal basic surface (forming the surface 2), which with the vertices come together in the centre of the block to be made and are attached to each other with the sides. It is also possible to build up the blocks from ribs and plates to attached thereon.

The blocks are lightweight and easy to assemble and easy to connect. They may be used as play device, climbing object for youngsters, solitary or in series. The blocks may also be used as training or competition object for climbers. Relatively large blocks, for instance 30 having a cross-section of 1 m, can then for instance be used for the climbing object, and with smaller blocks, for instance having a cross-section of 0.1 m, the build of the actual object can be copied and be used to determine a climbing strategy. Such samples can also be used in the concrete design of play devices.

In one embodiment the connection between two coupled blocks has been provided with a through-opening, enabling users of the clambering device to clamber along the inside from the one block to the other block. In one embodiment at least one of the sides where the blocks are connected or are to be connected to each other, has been provided with a through-opening or recess. In one embodiment at least one of the blocks of the clambering device has been provided with a passage 5 that offers access to or exit from the inside of the clambering device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A polygonal, substantially spherical block, having surfaces provided with means for attaching climbing holds onto the surfaces, the block being built up from polygonal plates and corner pieces, the polygonal plates defining at least four geometrical surfaces, of which surfaces at least three surfaces have normals, with one of the normals being at an angle to a surface defined by the other two normals, wherein at least two blocks are connected to each other at those surfaces, and wherein the corner pieces connect the polygonal plates to each other, and wherein the corner pieces are arranged externally on the blocks.

2. A polygonal, substantially spherical block, having surfaces provided with climbing holds, the block being built up from polygonal plates and corner pieces, the polygonal plates defining at least four geometrical surfaces, of which surfaces at least three surfaces have normals, with one of the normals being at an angle to a surface defined by the other two normals, wherein at least two blocks are connected to each other at those surfaces, and wherein the corner pieces connect the polygonal plates to each other, and wherein the corner pieces are arranged externally on the blocks.

3. A polygonal, substantially spherical block, provided with climbing holds and means for connection to another identically shaped block, on all surfaces, the block being built up from polygonal plates and corner pieces, the polygonal plates defining at least four geometrical surfaces, of which surfaces at least three surfaces have normals, with one of the normals being at an angle to a surface defined by the other two normals, wherein at least two blocks are connected to each other at those surfaces, and wherein the corner pieces connect the polygonal plates to each other, and wherein the corner pieces are arranged externally on the blocks.

4. The block according to claim 2, used as a clambering device.

5. The block according to claim 4, assembled from modular parts.

6. The block according to claim 5, built up from a construction kit of plates forming the sides and corner pieces.

7. The block according to claim 6, wherein the corner pieces are also adapted for connection of the block to another block.

8. The block according to claim 2, wherein the sides of the block are provided with holes for attaching connection means for the blocks.

9. Assembly of a block according to claim 6 and means for connection to a similarly shaped block.

10. The clambering device according to claim 1, wherein the geometrical surfaces form pentagons.

11. The clambering device according to claim 2, wherein the geometrical surfaces form pentagons.

12. The clambering device according to claim 3, wherein the geometrical surfaces form pentagons.

* * * * *